US008458870B2

(12) United States Patent
Haussler et al.

(10) Patent No.: US 8,458,870 B2
(45) Date of Patent: Jun. 11, 2013

(54) NEEDLE FOR A TEXTILE MACHINE

(75) Inventors: Hans Haussler, Porto (PT); Gustav Wizemann, Messstetten-Hossingen (DE); Christian Gerth, Albstadt (DE); Reinhold Eydner, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 89 days.

(21) Appl. No.: 12/704,668

(22) Filed: Feb. 12, 2010

(65) Prior Publication Data

US 2010/0251526 A1 Oct. 7, 2010

(30) Foreign Application Priority Data

Feb. 12, 2009 (EP) ..... 09152727

(51) Int. Cl.
*D04H 18/00* (2006.01)

(52) U.S. Cl.
USPC ..... 28/115

(58) Field of Classification Search
USPC ..... 28/107–115; 223/102; 24/48, 706.1, 24/711.1, 711.4, 706; 112/222, 226
See application file for complete search history.

(56) References Cited

U.S. PATENT DOCUMENTS

| | | | | |
|---|---|---|---|---|
| 321,864 | A | | 7/1885 | Taylor |
| 375,978 | A | | 1/1888 | Barraclough |
| 712,952 | A | | 11/1902 | McGill |
| 758,289 | A | | 4/1904 | Wittigschlager |
| 782,830 | A | | 2/1905 | Dancyger |
| 904,751 | A | | 11/1908 | Bernthold |
| 920,249 | A | * | 5/1909 | Bishop ..... 24/12 |
| 945,412 | A | | 1/1910 | Pettee |
| 1,219,070 | A | | 3/1917 | Bock |
| 1,731,556 | A | | 10/1929 | Wren et al. |
| 2,017,100 | A | * | 10/1935 | Lang ..... 223/102 |
| 2,318,235 | A | | 5/1943 | Lapham |

(Continued)

FOREIGN PATENT DOCUMENTS

| | | |
|---|---|---|
| DE | 1410492 A1 | 10/1968 |
| DE | 6606717 | 11/1970 |

(Continued)

OTHER PUBLICATIONS

Dipl.-Ing. W. Reichelt, "Moderne Filznadeln zur Erzeugung marktgerechter Vliesstoffe", Melliand Textilberichte, Deuscher Fachverlag, Frankfurt AM Main, DE, Bd. 73, Nr. 5, 1. May 1, 1992, Seiten 386-390, XP000273203, ISSN: 0341-0781.

(Continued)

*Primary Examiner* — Amy Vanatta
(74) *Attorney, Agent, or Firm* — Fitch, Even, Tabin & Flannery, LLP

(57) ABSTRACT

A needle (15) for a textile machine, in particular a felting needle or fork needle. A working section (17) extends along a longitudinal axis (16) and has a needle point (18). Adjoining the working section (17) are a lower shank section (20) and an upper shank section (25), both said shank sections extending coaxially with respect to each other along the longitudinal axis (16). Adjoining the upper shank section (25), there is provided a needle foot (30) that has a holding means (32) extending in a straight line in a transverse direction (31) transversely to the longitudinal axis (16). The diameter (E) of the upper shank section (25) is both greater than the diameter (D) of the lower shank section (20) and greater than the mean width of the holding means (32).

14 Claims, 6 Drawing Sheets

U.S. PATENT DOCUMENTS

| | | | | | |
|---|---|---|---|---|---|
| 2,327,416 | A | * | 8/1943 | Foster | 28/115 |
| 2,349,086 | A | * | 5/1944 | Foster | 28/115 |
| 2,391,560 | A | | 12/1945 | Foster | |
| 2,495,926 | A | | 1/1950 | Foster | |
| 2,548,521 | A | | 4/1951 | Doyle | |
| 2,663,065 | A | | 12/1953 | Dinham | |
| 2,857,650 | A | * | 10/1958 | Lauterbach | 28/115 |
| 2,873,507 | A | | 2/1959 | Kelson | |
| 2,882,585 | A | * | 4/1959 | Weickert | 28/115 |
| 3,388,443 | A | * | 6/1968 | O'Byrne | 28/115 |
| 3,397,436 | A | | 8/1968 | Zocher | |
| 3,464,097 | A | | 9/1969 | Zocher | |
| 3,680,182 | A | * | 8/1972 | Scott | 28/115 |
| 3,774,273 | A | | 11/1973 | Okamoto et al. | |
| 3,783,479 | A | * | 1/1974 | Terry | 28/115 |
| 3,815,186 | A | | 6/1974 | Foster | |
| 3,877,120 | A | * | 4/1975 | Okamoto et al. | 28/115 |
| 4,037,297 | A | * | 7/1977 | Foster | 28/115 |
| 4,540,108 | A | * | 9/1985 | Campbell | 223/102 |
| 5,897,935 | A | | 4/1999 | Ellis et al. | |
| 6,233,797 | B1 | * | 5/2001 | Neely et al. | 28/115 |
| 8,245,372 | B2 | | 8/2012 | Haussler et al. | |
| 2005/0251978 | A1 | * | 11/2005 | Foster | 28/115 |
| 2006/0026810 | A1 | * | 2/2006 | Wizemann | 28/115 |
| 2007/0143975 | A1 | * | 6/2007 | Falk et al. | 28/115 |

FOREIGN PATENT DOCUMENTS

| | | | |
|---|---|---|---|
| DE | 6606717 | U | 11/1970 |
| DE | 2108115 | A1 | 9/1971 |
| DE | 3105358 | | 9/1982 |
| DE | 3105358 | A1 | 9/1982 |

OTHER PUBLICATIONS

Reichelt, W.; "Moderne Filznadeln zur Erzeugung marktgerechter Vliesstoffe", Melliand Textilberichte, Deuscher Fachverlag, Frankfurt AM Main, DE, Bd. 73, Nr. 5, 1. May 1, 1992, Seiten 386-390, XP000273203, ISSN: 0341-0781.

Korean Patent Office Action dated Dec. 22, 2011, issued in Korean Application No. 10-2010-0012281.

* cited by examiner

NEEDLE FOR A TEXTILE MACHINE

CROSS-REFERENCE TO RELATED APPLICATION

The present application claims the priority of European Patent Application No. 09 152 727.5, filed Feb. 12, 2009, the subject matter of which, in its entirety, is incorporated herein by reference.

BACKGROUND OF THE INVENTION

The invention relates to a needle for a textile machine, in particular, to a felting needle or fork needle.

Such needles have been known. For example, document U.S. Pat. No. 2,663,065 discloses a felting needle that consists of a piece of bent wire. The working section has a needle tip, as well as several radially extending barbs. The lower shank section, the upper shank section and the needle foot are made by bending the piece of wire. In the region of the upper shank section, the other free end of the piece of wire opposite the needle point is bent back parallel with respect to the longitudinal axis, thus forming the upper shank section by two wire sections extending parallel to each other. The needle foot consists of an approximately oval loop that delimits an area having an area normal in the direction of the longitudinal axis.

It is the object of the present invention to create a needle that is suitable for high operating speeds and, at the same time, exhibits sufficient flexural strength. This object is achieved with a needle displaying the features of patent claim 1.

SUMMARY OF THE INVENTION

Considering the needle in accordance with the invention, a working section, a lower or first shank section, as well as an upper or second shank section are arranged coaxially with respect to a longitudinal axis that essentially extends in the direction of movement of the needle. As a result of this coaxial arrangement of the three sections, the needle is imparted with sufficient stability, even when work is performed at high operating speeds. Adjoining the second shank section is the needle foot. This needle foot may also be formed by two regions. A first region, the foot connection, is arranged coaxially with respect to the longitudinal axis of the needle in extension of the upper shank section. The second region of the needle foot, the holding means of the needle foot, is arranged transversely with respect to the longitudinal axis of the needle. This holding means of the needle foot thus extends away from the longitudinal axis. The length of the holding means extends along a longitudinal central axis of the holding means of the needle foot, i.e., as a rule, in a direction away from the longitudinal axis of the needle. Considering special embodiments, the length of the holding means of the needle foot may extend to several sides of the longitudinal axis of the needle. The longitudinal axis of the holding means of the needle foot defines a transverse direction. The longitudinal axis of the holding means of the needle foot and the longitudinal axis of the needle are preferably arranged so as to form a right angle between them. In special applications, the arrangement of the longitudinal axis between them may deviate minimally by 1 to 2 degrees from a right angle. The width of the holding means of the needle foot is measured transversely in the direction of the normal of the longitudinal axis of the holding means of the needle foot. This normal defines a width direction. The transfer of force from a needle holder of the textile machine to the needle can occur via the needle foot and act in the direction of the longitudinal axis.

In accordance with the invention, the diameter of the lower shank section, measured transversely with respect to the longitudinal axis of the needle, as well as the mean width of the holding means of the needle foot, measured transversely with respect to the longitudinal axis of the needle foot, is smaller than the diameter of the upper shank section. The mean width is understood to mean the mean value of the width of the holding means of the needle foot, because the width of the needle foot as a function of said foot's cross-sectional form need not be constant. The upper shank section is disposed to support the needle in a needle bed and may display a standardized diameter. The other sections of the needle have smaller dimensions, as a result of which the inertia of the needle can be reduced. The width of the holding means of the needle foot and the diameter of the lower shank section have dimensions that are such that the required flexural strength of the needle is achieved. Due to this reduced inertia, higher accelerations and higher operating speeds can be achieved while, at the same, the needle displays sufficient flexural strength.

Advantageous embodiments of the needle in accordance with the invention are obvious from the dependent patent claims.

The outside surface of the upper shank section may have abutment sites that are, in particular, regularly distributed on its circumference, said abutment sites being arranged about the longitudinal axis on a common lateral cylinder surface. The abutment sites may be arranged on the outside surface in a straight line parallel to the longitudinal central axis of the needle. It is also possible to configure the upper shank section twisted in the form of a spiral. Then, the abutment surfaces are arranged in the form of a spiral on the lateral cylinder surface describing the diameter of the upper shank section. In so doing, the abutment sites represent sites at a radial distance from the longitudinal axis, said distance being greater than the radial distance of the outside surface of the lower shank section from the longitudinal axis and being greater than half the mean width of the holding means of the needle foot. The outside surface section of the upper shank section located between the abutment sites, in so doing, are located inside the common lateral cylinder surface. In operative position of the needle, the abutment sites abut, in order to support said needle, in a direction transverse to said needle's longitudinal surface, against a counter abutment surface of a needle holder of the textile machine. Free spaces may remain in the region between the abutment sites. The advantage of this embodiment is a reduced inertia and thus a reduced moment of inertia of the needle, so that said needle can be used at high operating speeds.

The cross-section of the upper shank section may be different from a circular contour and have a cross-sectional form that is, for example, polygonal, triangular, cruciform, star-shaped, oval or ellipse-like. Corner regions and/or edge regions of the different cross-sectional forms may be provided with radii or be curved, as a result of which an edgeless outside surface of the upper shank section may be achieved.

The needle in accordance with the invention is intended, in particular, for use in a needle holder of a textile machine, with a needle board having an upper side with several parallel-extending grooves, whereby—along each groove—several bores are provided, said bores being at a distance from each other and completely extending through the needle board from the upper side to the opposing underside. The diameter of the bores is greater than a mean value of the groove width or than the groove width at the groove base, and, in particular at the transition site between the groove flanks and the groove base. Due to the reduced groove width, it is possible to arrange more grooves on a needle board than before, without impairing the stability of the strips between adjacent grooves. The bores in the adjacent grooves may be arranged offset relative to each other in order to be able to arrange the grooves sufficiently closely next to each other.

Additional details of the embodiments of the invention are obvious from the description, the drawings or the claims. The description is restricted to essential details of the embodiments of the invention and other situations. The drawings disclose additional details and are to be referred to as being supplementary.

DETAILED DESCRIPTION OF THE INVENTION

Figures 1, 2, 3:
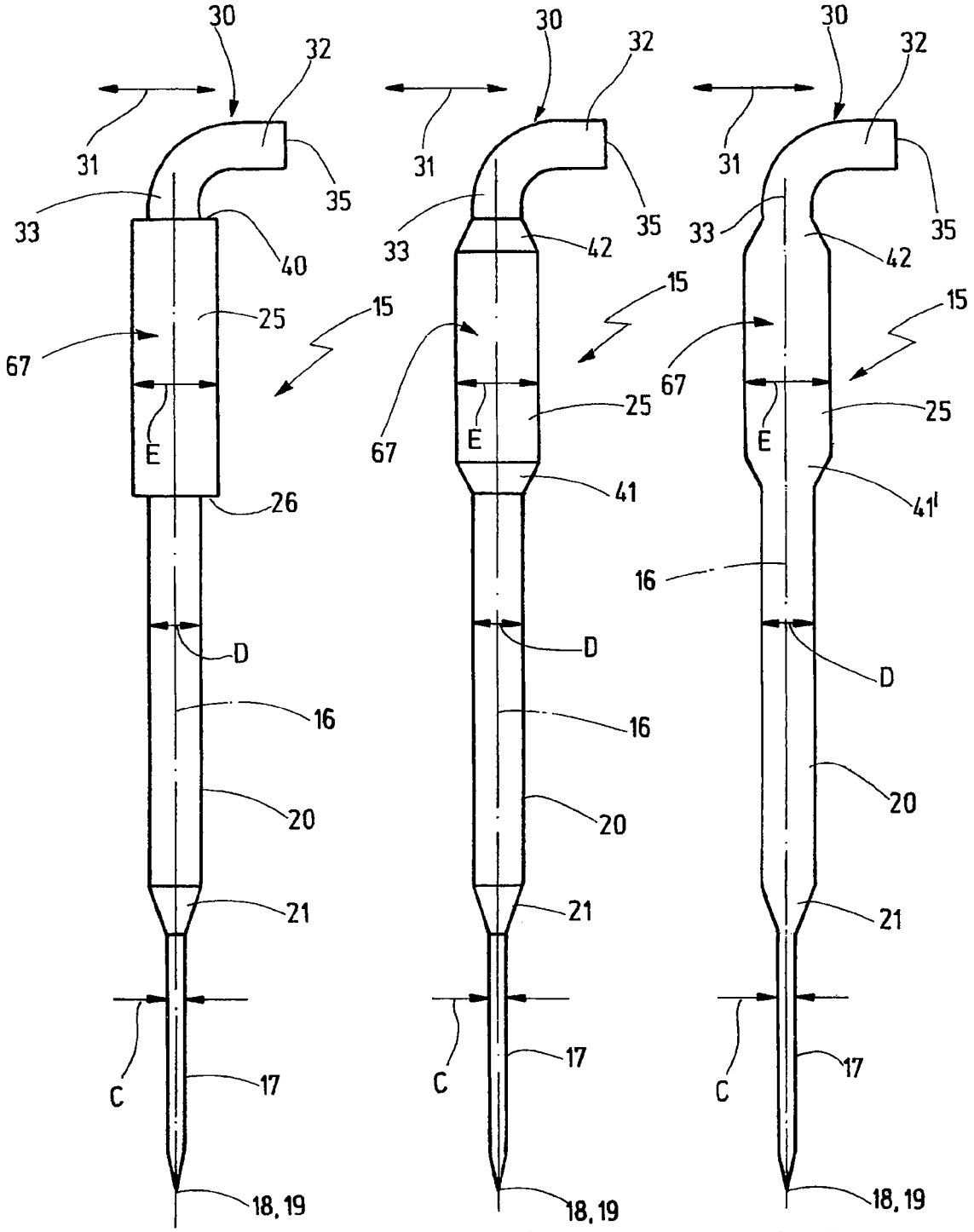
FIG. 1 is a schematic illustration, in a side view, of a first exemplary embodiment of a needle.
FIG. 2 is a schematic illustration, in a side view, of a modified embodiment of the needle in accordance with FIG. 1.
FIG. 3 is a schematic illustration, in a side view, of another modified embodiment of the needle in accordance with FIG. 1.

FIGS. 1 through 5 show various embodiments of a needle 15.

The needle 15 is a needle for a not specifically shown textile machine, in particular a felting machine, for example a felting needle or a fork needle.

The needle 15 has a working section 17 extending along a longitudinal axis 16, whereby a needle point 18 is provided on said working section. The needle point 18 represents the first free end 19 of the needle 15.

Adjoining the working section 17, is a lower shank section 20 that extends coaxially with respect to the longitudinal axis 16 and coaxially with respect to the working section 17. The lower shank section 20 has a circular cross-section with a diameter D that is greater than the diameter C of the working section 17. The diameter of a shank section 20 or the working section 17 of the needle 15 corresponds to the smallest-possible diameter of a lateral cylinder surface of a circular cylinder, said lateral cylinder surface extending coaxially with respect to the longitudinal axis 16 and completely circumscribing the respective shank section. In so doing, no parts of the respective section extend through the lateral cylinder surface. Due to the different diameters of the working section 17 and of the lower shank section 20, these two sections 17, 20 are connected to each other by means of a conical first transition region 21, said region widening continuously from the working section 17 toward the lower shank section 20.

Referring to the embodiments in accordance with FIGS. 1, 2, 4 and 5, the outside surface of the first transition region 21 corresponds to the lateral surface of a truncated cone. Different therefrom, the embodiment of the needle 15 in accordance with FIG. 3 implements a modified embodiment of the first transition region 21' that creates an edgeless transition between the working section 17 and the lower shank section 20.

An upper shank section 25 adjoins the lower shank section 20 with the circular cross-section, the cross-section of said upper shank section—in the simplest case—being potentially also circular, as is schematically shown in FIGS. 1 through 5.

Considering the exemplary embodiment in accordance with FIG. 1, a first step 26 is provided between the lower shank section 20 and the upper shank section 25, said step having the configuration of an annular surface because the diameter E of the upper shank section 25 is greater than the diameter D of the lower shank section 20.

A needle foot 30 adjoins the upper shank section 25, said needle foot having a holding means 32 that essentially extends in a straight line. This holding means 32 extends along a transverse direction 31 that is transverse to the longitudinal axis 16 of the needle 15.

The holding means 32 may extend in a straight line up to the free end 35 or between the two free ends 35', 35". The holding means 32 is connected, via a foot connection 33 of the needle foot 30, with the upper shank section 25, said foot connection 33 being curved in the exemplary embodiments of the needle in accordance with FIGS. 1 through 5. The foot connection 33 of the needle foot 30 is bent over a radius by approximately 90°.

Figure 7A:
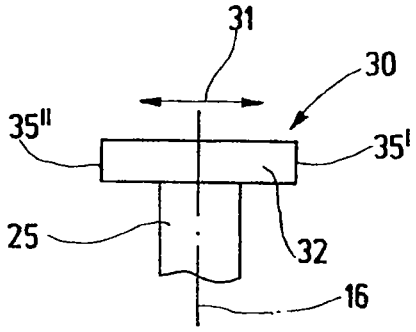
FIGS. 7*a* and 7*b* are a schematic views of a modified embodiment of the needle foot of the needle in a side view (FIG. 7*a*) and in a front view (FIG. 7*b*).
Figure 7B:
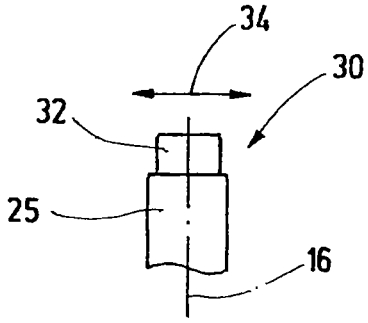

The mean width of the holding means 32, i.e., the mean value of the width of the holding means 32, in width direction 34 (FIG. 7*b*) is smaller than the diameter E of the upper shank section 25. (Originating from the plane of projection of FIGS. 1 through 5, the width direction 34 corresponds to the normal of this plane of projection.) Referring to the embodiment of the needle 15 in accordance with FIGS. 1 through 5, the width of the holding means 32 of the needle foot 30 corresponds to the diameter D of the lower shank section 20.

The upper shank section 25 may form—viewed in transverse direction 31—an L-shaped or T-shaped holding region of the needle 15 with the needle foot 30, said holding region being disposed to support the needle 15 in a needle holder 45.

Considering the embodiment of the needle in accordance with FIG. 1, another, second step 40 is formed between the foot connection 33 and the upper shank section 25. The two steps 26, 40 delimiting the upper shank section 25 form annular ring surfaces extending coaxially with respect to the longitudinal axis 16, said annular surfaces facing away from each other. Different therefrom, considering the modified embodiment of the needle 15 in accordance with FIG. 2, a conical, second transition region 41 is arranged between the lower shank section 20 and the upper shank section 25, and a conical, third transition region 42 is provided between the upper shank section 25 and the needle foot 30. Referring to a modified embodiment of the needle 15 in accordance with FIG. 3, the second transition region 41' and the third transition region 42' are also configured without edges.

The exemplary embodiments of the needle 15 in accordance with FIGS. 1 through 5 differ from the different embodiment of the transitions between the various sections 17, 20, 25, 30 of the needle 15. In so doing, any combination of the illustrated transition regions 21, 21', 26, 40, 41, 41', 42, 42' is possible. The lower shank section 20, the upper shank section 25, as well as the holding means 32 of the needle foot 30 or the entire needle foot 30 each have an unchanged cross-section along their entire extension. The change of the cross-section occurs either by the formation of steps 26, 40 or by the transition regions 21, 21', 41, 41', 42, 42'. The flexural strength of one or more of the transition regions 21, 21', 41, 41', 42, 42' may be increased by not illustrated shaped reinforcement ribs.

Figure 4:
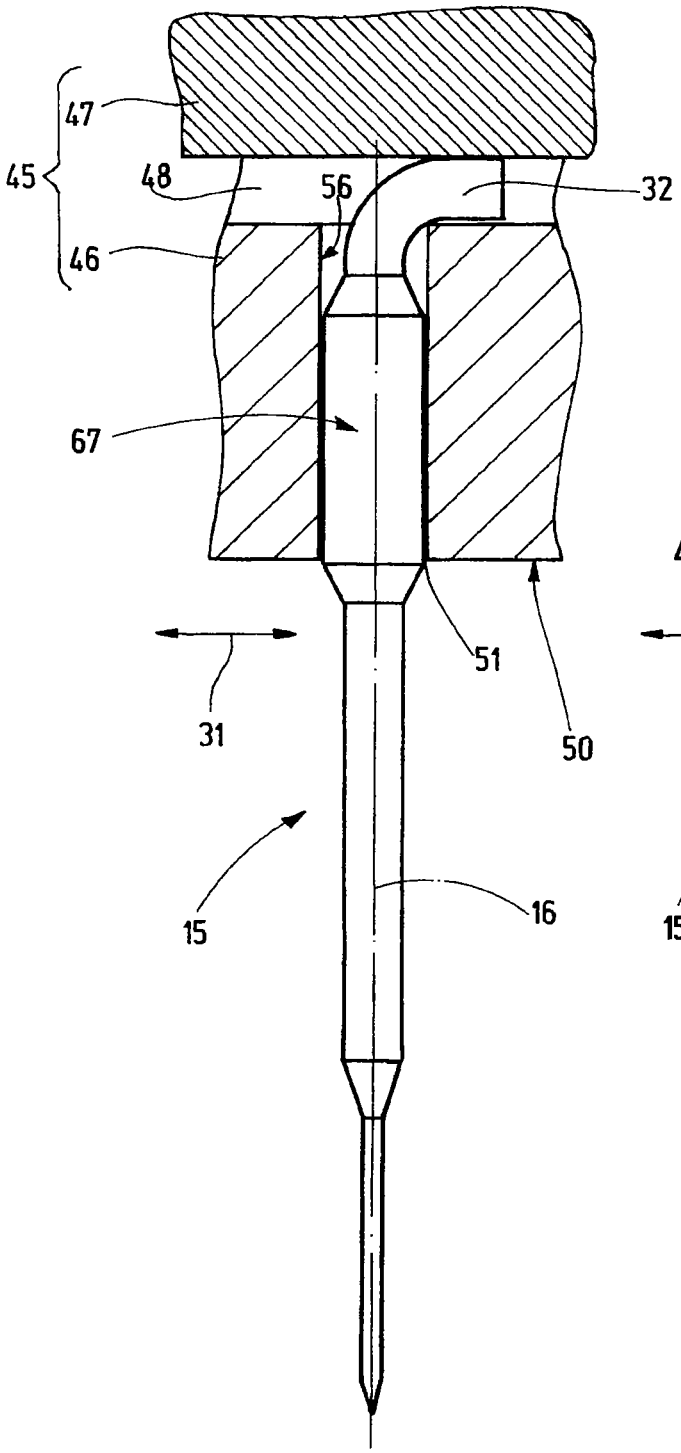
FIG. 4 is a schematic illustration, in a side view, of the exemplary embodiment of the needle in accordance with FIG. 2 in an operative position.

FIG. 4 shows the modified embodiment of the needle in accordance with FIG. 2 in operative position, whereby the needle 15 is inserted in a schematically illustrated needle holder 45.

In the description hereinafter it is assumed, for example, that a needle board is arranged above the planar textile material that is to be processed. Basically, such a needle board may, additionally or alternatively, also be arranged below the planar textile material.

The needle holder 45 comprises a needle board 46 and a needle bar 47. Grooves 48 are provided in the needle board 46, said grooves being open toward an upper side 44 and extending—parallel to each other—at a distance from each other in one direction. The grooves 48 have oppositely arranged groove flanks 55 adjacent to the grooves' open side, said flanks delimiting the groove 48 in groove width direction 92, said width direction corresponding to the width direction 34 of the needle 15 with the needle inserted in the needle board 46. The two groove flanks 55 are connected to each other via a groove base 70.

Two adjacent grooves 48 are separated by a distance in the form of a strip 49. A plurality of bores 51 extend from the upper side 44 to an opposite underside 50 through the needle board 46. In the region of the upper side 44, the bores 51 terminate in the grooves 48. The central axis 52 of the bores extends—approximately centered—through the respective groove 48 in groove width direction 92. Several bores 51 are provided along each groove 48.

Figure 5:
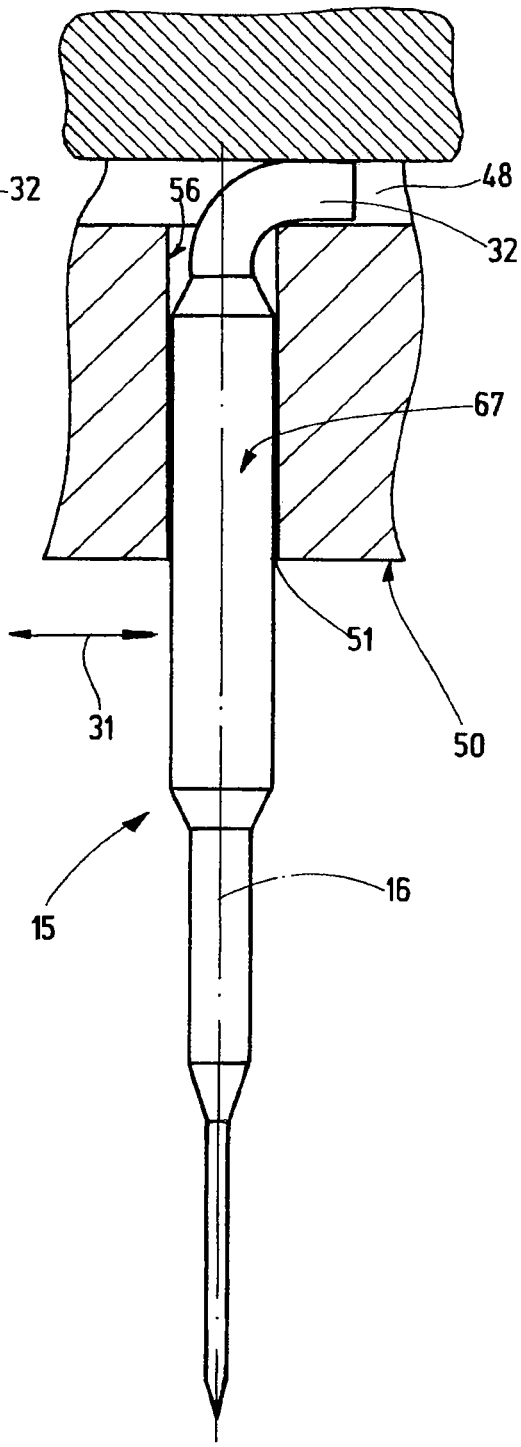
FIG. 5 is the same view of a modification of the exemplary embodiment of the needle in accordance with FIG. 4.

As is obvious from FIGS. 4 and 5, the holding means 32 of the needle foot 30 is inside a groove 48 in operative position of the needle 15, so that the needle 15 and, in particular, its working section 17, cannot rotate about the longitudinal axis 16. The rotational position of the needle 15 is thus prespecified and fixed.

The upper shank section 25 is arranged at least partially inside the bore 51 and abuts against several peripheral sites on the hollow cylindrical counter abutment surface 56 of the bore 51. As a result of this, a shifting of the needle 15 transversely with respect to its longitudinal axis 16 is being avoided. The upper shank section 25 may be dimensioned in the direction of the longitudinal axis 16 in such a manner that said shank section is approximately flush with the underside 50 of the needle board 46 or, alternatively, projects beyond the underside 50 of the needle board 46 in order to achieve a greater flexural strength of the needle 15 in this region.

By modifying the embodiments of the needle 15 in accordance with FIGS. 1 through 5, it is also possible—for the upper shank section 25 as well as for the holding means 32 of the needle foot 30—to have a cross-sectional form that is different from the circular cross-section.

Possible cross-sectional forms of the upper shank section 25 are shown as examples in FIGS. 6*a* through 6*f*. As a result of this cross-sectional form that is different from the circular cross-sectional form, the abutment sites 60 are formed distributed over the circumference of the upper shank section 25, said abutment sites being located on a common lateral cylinder surface 61 about the longitudinal axis 16. If the upper shank section 25 is twisted about the longitudinal axis 16 of the needle in the form of a spiral (not illustrated), the abutment sites 60 follow this spiral along the lateral cylinder surface 61 of the shank section 25. The diameter of this lateral cylinder surface 61 corresponds to the diameter E of the upper shank section 25. Considering the preferred exemplary embodiments of the cross-sectional forms of the upper shank section 25, the abutment sites 60 are regularly distributed—viewed in circumferential direction, whereby said abutment sites are arranged parallel to the longitudinal axis 16 of the needle. The number of abutment sites 60 and their form is a function of the selected contour of the cross-section. If the abutment sites 60 are arranged over a larger area on the lateral cylinder surface 61, two opposing abutment sites 60 may be sufficient. Preferably, three, four or also more abutment sites 60 are provided in a regular manner distributed over the circumference on the outside surface 67 of the upper shank section 25. The diameter of the lateral cylinder surface 61, on which the abutment sites 60 are arranged, corresponds approximately to the diameter of the bores 51 in the needle board 46. Therefore, the abutment sites 60 represent the surface areas of the upper shank section 25 that are disposed to abut against the inside surface 56 of the bore 51, said bore—as it were—representing a counter abutment surface 56 for the abutment sites 60.

A recess 65 is provided between each two abutment sites 60. The radial distance of the outside surface region of the upper shank section 25 is smaller—everywhere in the region of a recess 65—between two abutment sites 60 that at the abutment site 60. Consequently, abutment sites 60 are found only on the common lateral cylinder surface 61.

Figure 8A:
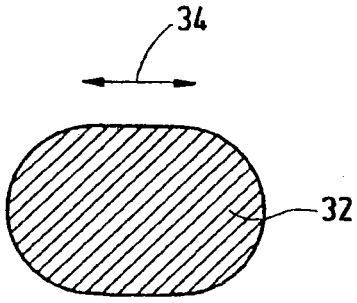
FIGS. 8*a* through 8*f* are various cross-sectional forms of the holding means of the needle foot.
Figure 8B:
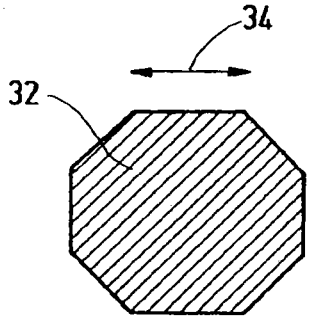
Figure 8C:
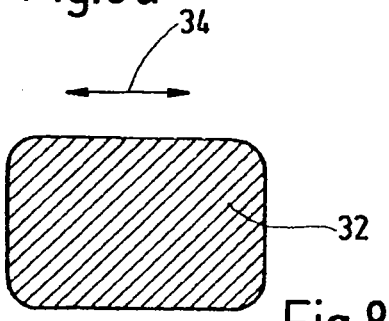

The upper shank section 25 may have, for example, a polygonal, in particular rectangular or, as shown in FIG. 8*a*, a square cross-section. Each corner of the polygon has the same distance from the longitudinal axis 16 of the needle, so that longitudinal edges extending along the upper shank section 25 in longitudinal direction along the longitudinal axis 16 form longitudinal abutment sites 60.

Figure 6A:
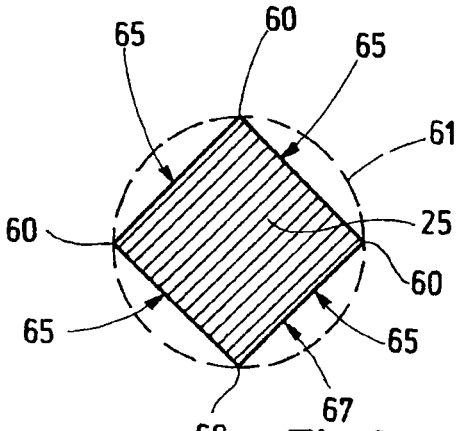
FIGS. 6*a* through 6*f* are various cross-sectional forms of the upper shank section of the needle.
Figure 6B:
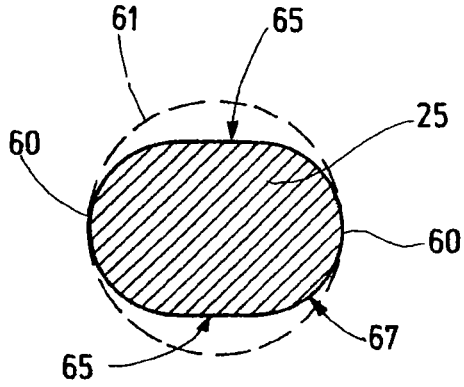

FIG. 6*b* shows an oval (form of a race-track) or an ellipse-like cross-sectional form of the upper shank section 25. The abutment sites 60 are provided in the region of the main vertices. In the region of the ancillary vertices, the oval or ellipse is flattened, so that the upper shank section 25 has plane outside surface sections 67 on two opposing sides in the region of the ancillary vertices, said outside surface sections representing the recesses 65 between the two abutment sites 60.

Figure 6C:
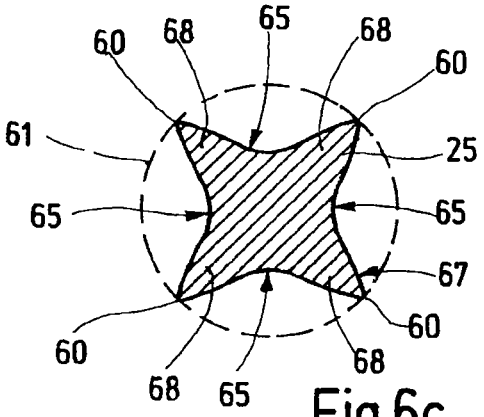
Figure 6D:
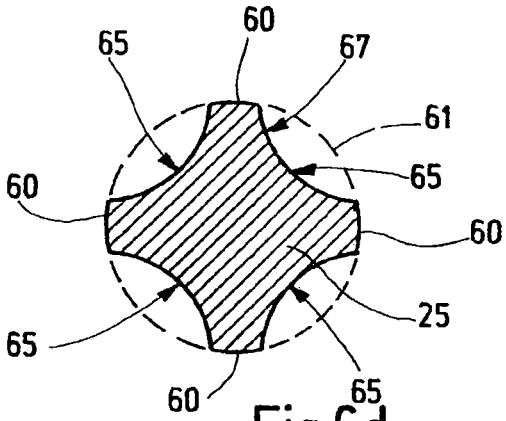

Alternatively, the cross-section of the upper shank section 25 may also have the contour of a star or a cross, as is obvious, for example, from FIGS. 6*c* and 6*d*. The star-like cross-sectional contour has several star points 68, whereby the abutment sites 60 are formed on their radially outermost ends. The recesses 65 are provided between two adjacent star points 68. Considering the exemplary embodiment in accordance with FIG. 6*c*, the star-shaped cross-sectional contour of the upper shank section 25 comprises star points 68 that are uniformly distributed over the circumference, said points extending outward from a central region about the longitudinal axis 16 and, in so doing, tapering toward their radially outermost end. At this radially outermost end, the star points 68 are rounded, so that, preferably, no sharp edges are formed on the abutment sites 60. The outside surface section 67 of the recess 65 is curved concavely inward in a V-like manner. The transition between the star points 68 is without edge. By modifying the illustrated embodiment, it is also possible to provide more than four star points 68.

Considering the cruciform cross-section of FIG. 6*d*, the abutment sites 60 are curved convexly outward in radial direction, whereby the curvature has, in particular, the same radius as the lateral cylinder surface 61. The recesses 65 between the abutment sites 60 are formed by the concavely curved outside surface sections 67 of the upper shank section 25, said outside surface sections displaying an arcuate shape viewed in cross-section of the upper shank section 25.

Figure 6E:
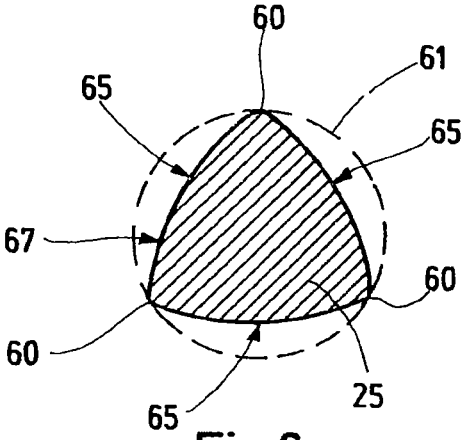
Figure 6F:
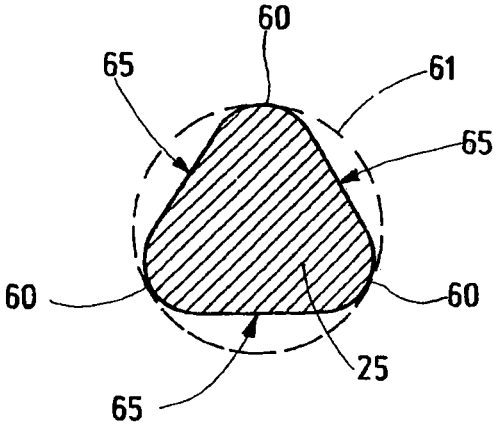

The two cross-sectional forms in accordance with FIGS. 6*e* and 6*f* provide a triangle-like cross-sectional form for the upper shank section 25. In the exemplary embodiment in accordance with FIG. 6*e*, the three outside surface sections 67 of the upper shank section 25 are convexly curved outward. The points of the triangle are also provided with a radius, so that the entire outside surface of the upper shank section 25 is configured without sharp edges and corners. The points represent the abutment sites 60 and are located on the common lateral cylinder surface 61. The curved outside surface sections 67 between the abutment sites 60 represent the recesses 65.

Considering the triangle-like cross-sectional form shown in FIG. 6*f*, the recesses 65 are represented by three plane outside surface sections 67 of the upper shank section 25, said outside surface sections being distributed over the circumference in a regular manner. Viewed in circumferential direction, the abutment sites 60 are provided between these plane outside surfaces, said abutment surfaces being curved outward, for example, with a radius. The radius of the abutment sites 60 has a maximum size that is as large as the radius of the lateral cylinder surface 61 and—in the preferred exemplary embodiment according to FIG. 6*f*—is smaller than the radius of the common lateral cylinder surface 61.

The described exemplary embodiments of the cross-sectional form of the upper shank section 25 may deviate from the preferred embodiments shown in FIGS. 6*a* through 6*f*. For example, the corners and edges of a polygonal cross-section may be curved or provided with radii, so that an external outside surface of the upper shank section 25 without corners and edges is achieved. In all exemplary embodiments, the symmetry of the cross-sectional form of the upper shank section 25 is selected in such a manner that the center of gravity of the upper shank section 25 is located on the longitudinal axis 16.

The needle 15 may be manufactured from a needle blank in a very simple manner, for example a wire pin. The diameter of the needle blank may correspond to the diameter D of the lower shank section 20, so that the needle blank may remain unchanged in this section. The upper shank section 25 and/or the needle foot 30 are shaped by a non-cutting manufacturing technique such as, e.g., by reshaping by pulling, pushing or pressure, in particular, by extrusion. The needle 15—overall and, in particular, also its working section 17, its lower and upper shank sections 20, 25, as well as its foot part 30, each viewed by itself—is made continuously of one piece of a uniform material without commissures. This represents a simple and cost-effective possibility of reshaping the needle blank in the region of the upper shank section 25 and in the region of the needle foot 30 and to impart it with a desired cross-sectional form. During this reshaping process, the area of the cross-section of the upper shank section 25 remains preferably unchanged, so that it corresponds to the area of the lower shank section 20.

The holding means 32 of the needle foot 30 of the needle 15 can be shaped by simply bending the foot connection 33 of the needle foot 30 in a manner as is the case with the needles 15 in accordance with the exemplary embodiments of FIGS. 1 through 5. In so doing, the diameter of the needle foot 30 along its entire extension corresponds approximately to the diameter D of the lower shank section 20. Alternatively, however, it is also possible for the needle foot 30, in particular its holding means 32, to have any other cross-sectional contour. In particular, the needle foot 30, or at least its holding means 32, may be symmetrical to a plane of symmetry that is defined by the longitudinal axis 16 and the width direction 34, as is shown, for example, in FIG. 7*a*. In accordance with the exemplary embodiments of FIGS. 7*a* and 7*b*, the needle foot 30 is entirely formed by the holding means 32 that is arranged directly adjoining the upper shank section 25. In accordance with FIG. 7*a*, the holding means 32 extends in two opposite radial directions away from the longitudinal axis 16. In so doing, the holding means 32 extends in a straight line from a first free end 35' to a second free end 35".

FIGS. 8*a* through 8*f* show various possible cross-sectional forms of the holding means 32 of the needle foot 30.

Figure 8D:
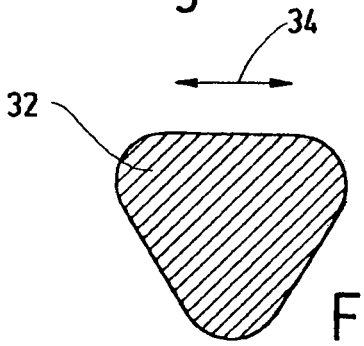
Figure 8E:
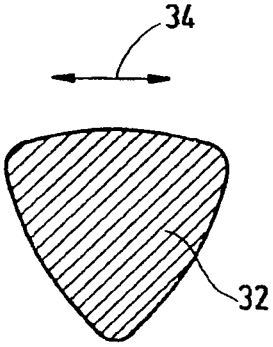
Figure 8F:
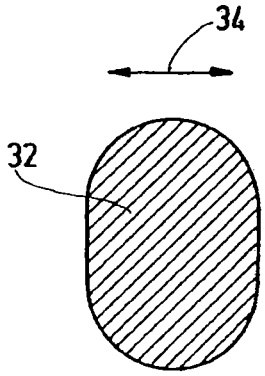
Figure 9:
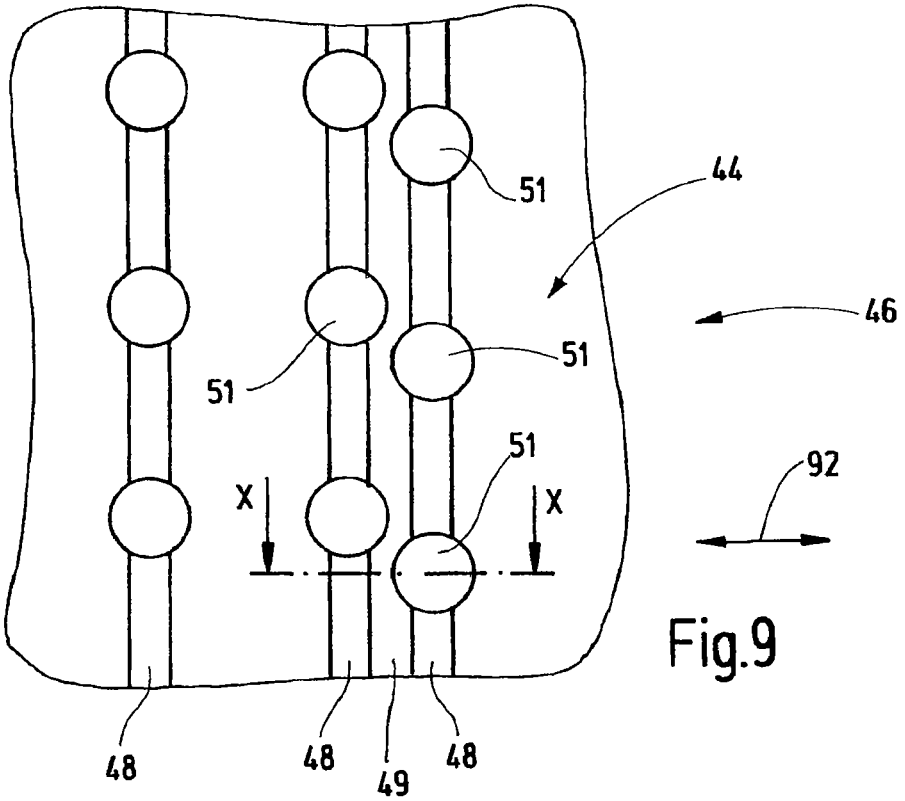
FIG. 9 is a schematic illustration of a detail in plan view of the upper side, of a needle board of a needle holder of a textile machine.
Figure 10:
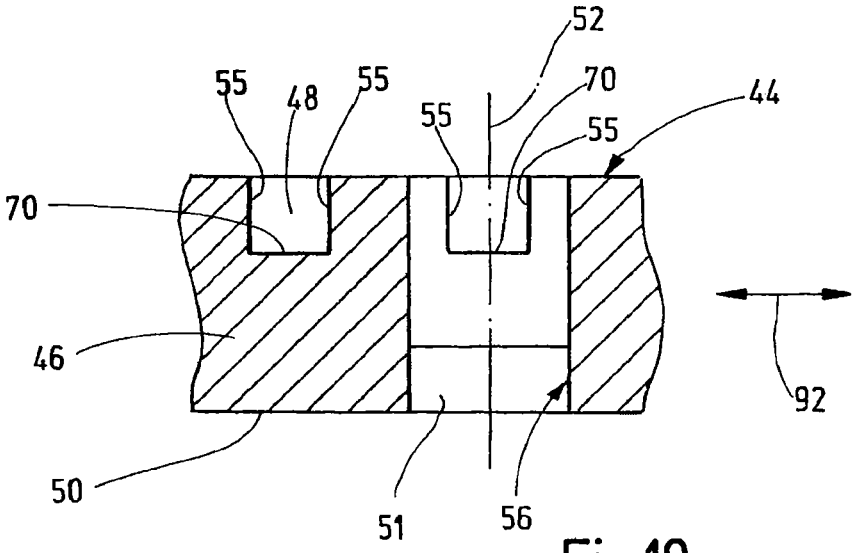
FIG. 10 is a sectional view, along line X-X, of a detail of the needle board of FIG. 9, on another scale.

The mean value of the width and, in particular, the width of the holding means 32, is smaller at any point in width direction 34 than the diameter E of the upper shank section 25. The cross-section of the holding means 32 may be oval (having the shape of a race-track) or elliptical. Considering the exemplary embodiment in accordance with FIG. 8*b*, the cross-section of the holding means 32 is polygonal and, for example, represents a regular octagon. The corners of such a polygon may also be rounded, for example have a radius as is shown, for example, with reference to a rectangle in FIG. 8*c*. Considering the two exemplary embodiments in accordance with FIGS. 8*d* and 8*e*, the cross-section of the holding means 32 has a triangular form. As in FIG. 8*c*, the corner regions of the triangle-like cross-sectional configuration in accordance with FIG. 8*d* are provided with radii. The radii in the corner regions of the cross-section in accordance with FIG. 8*e* are distinctly smaller than in the case of the modification of the embodiment shown in FIG. 8*d*. Different from FIG. 8*d*, the sides of the triangle in the triangular cross-section in accordance with FIG. 8*e* protrude outward.

The cross-section of the grooves 48 of the needle board 46 may have a form different from a rectangular form; in particular, it may be adapted to the cross-sectional form of the holding means 32 of the needle 15 that are to be accommodated on the needle board 46. FIGS. 11*a* through 11*f* show various possible cross-sectional forms of the grooves 48.

Considering all the cross-sectional forms of the groove 48, the groove width B in the transition region between the groove flanks 55 and the groove base 70 is smaller than the diameter of the bore 51. Also, the mean value of the groove width B, which may change as a function of the viewed site on the groove flanks 55 or the groove base 70, is smaller than the diameter of the bore 51. In so doing, the groove width B may—at any point—be smaller than the diameter of the bore 51, as is the case with the groove diameters in accordance with FIGS. 11*a*, 11*b*, 11*d* and 11*f*. The mean value of the groove width B may be approximately half of the diameter of the bore 51.

Figure 11A:
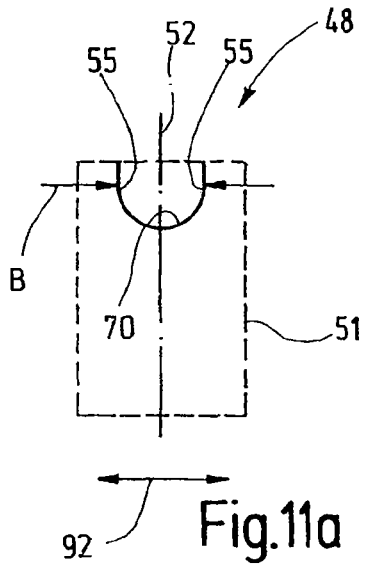
FIGS. 11*a* through 11*f* are various cross-sectional forms of the groove in the upper side of the needle board in accordance with FIGS. 9 and 10.

In FIG. 11*a* the cross-section of the groove is U-shaped with a channel-like groove base 70. A form, that is a modification thereof, is shown in FIG. 11*f*, where the groove base 70 consists of two surface sections 70*a*, 70*b*. Each of the two surface sections 70*a*, 70*b* is connected with one of the two groove flanks 55 and is inclined toward the central axis 52 by an angle of inclination of approximately 60°, for example. In the center of the groove the two surface sections 70*a*, 70*b* abut against each other while forming an edge and subtend the double angle of inclination.

Figure 11B:
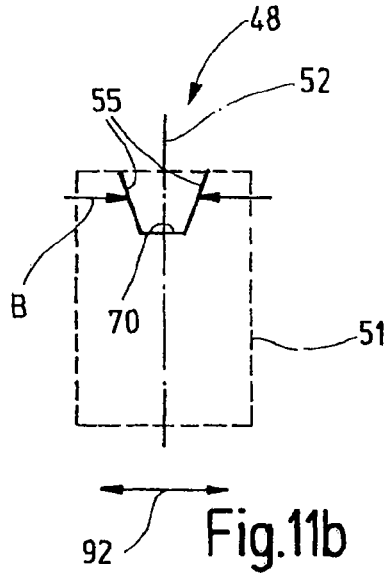
Figure 11C:
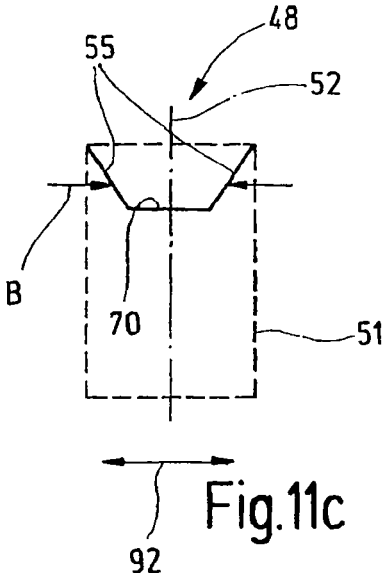

FIGS. 11*b* and 11*c* show another groove shape having a trapezoidal cross-section, whereby the groove base 70 extends transversely to the central axis 52 in width direction 34. The two groove flanks 55 are inclined relative to the central axis 52 of the bore 51. In accordance with FIG. 11*c*, the width B of the groove 48 on the upper side 44 of the needle board 46 corresponds to the diameter of the bore 51. Inasmuch as the two groove flanks 55, extending from the upper side 44 of the needle board 46, are arranged so as to be inclined in the direction of the central axis 52 of the bore 51, the mean width of the groove 48 is smaller than the diameter of the bore 51.

Figure 11D:
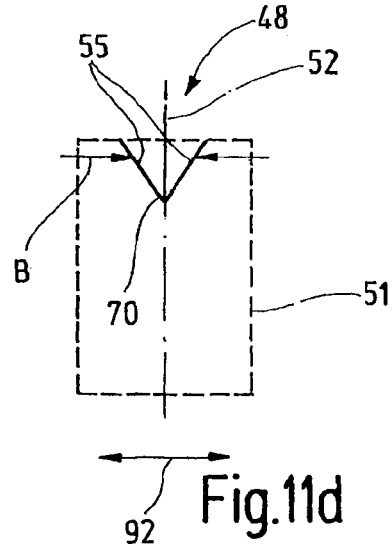
Figure 11E:
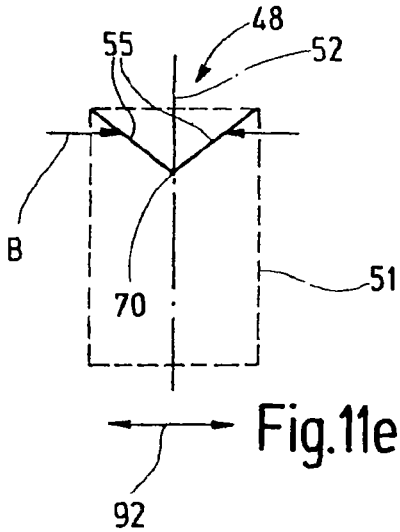
Figure 11F:
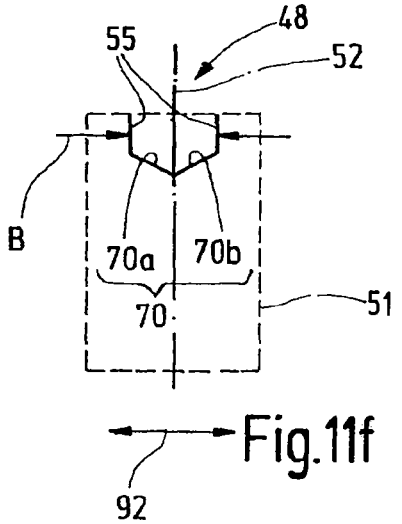

FIGS. 11*d* and 11*e* show triangular groove cross-sections, whereby the groove base 70 is formed by an edge in the transition region of the two groove flanks 55, said edge extending in the direction of the extension of the groove 48. The groove flanks 55 are arranged in a V-shape relative to each other and form an acute angle.

The invention relates to a needle 15 for a textile machine, in particular a felting needle or fork needle. A working section 17 extends along a longitudinal axis 16 and has a needle point 18. Adjoining the working section 17 are a lower shank section 20 and an upper shank section 25, both said shank sections extending coaxially with respect to each other along the longitudinal axis 16. Adjoining the upper shank section 25, there is provided a needle foot 30 that has a holding means 32 extending in a straight line in a transverse direction 31 transversely to the longitudinal axis 16. The diameter E of the upper shank section 25 is both greater than the diameter D of the lower shank section 20 and greater than the mean width of the holding means 32.

LIST OF REFERENCE NUMERALS

15 Needle
16 Longitudinal axis
17 Working section
18 Needle point
19 Free end of 15
20 Lower shank section
21 First transition region
21' First transition region
25 Upper shank section
26 First step
30 Needle foot
31 Transverse direction
32 Holding means
33 Foot connection
34 Width direction
35 Free end of 32
35' Free end of 32
35" Free end of 32
40 Second step
41 Second transition region
41' Second transition region
42 Third transition region
42' Third transition region
44 Upper side of 46
45 Needle holder
46 Needle board
47 Needle bar
48 Groove
49 Strip
50 Underside of 46
51 Bore
52 Central axis of 51
55 Groove flank
56 Counter abutment surface
60 Abutment site
61 Lateral cylinder surface
65 Recess
67 Outside surface sections
68 Star point
70 Groove base
70*a* Surface section of 70
70*b* Surface section of 70
B Groove width
C Diameter of 17
D Diameter of 20
E Diameter of 25

What is claimed is:

1. Needle for a textile machine, the needle comprising: a felting or fork needle for a felting process, the felting or fork needle comprising:

a working section (17) with a needle point (18), said working section extending along a longitudinal axis (16), a lower shank section (20) adjoining the working section (17), with an upper shank section (25) adjoining said lower shank section, wherein the two shank sections (20, 25) extend coaxially with respect to each other along the longitudinal axis (16), and a needle foot (30) adjoining the upper shank section (25) and comprising a holding means (32) that essentially extends in a straight line in a transverse direction (31) transversely to the longitudinal axis (16), the holding means shaped to correspond to and engage a groove of a needle board having a bore configured to engage the upper shank section of the needle foot, wherein a diameter (E) of the upper shank section (25) is both greater than a diameter (D) of the lower shank section (2) and greater than a mean width of the holding means (32).

2. Needle in accordance with claim 1, characterized in that the lower shank section (20) and/or the upper shank section (25) and/or the needle foot (30) and/or the holding means (32) of the foot section (30) each have an unchanged cross-section over their entire extension.

3. Needle in accordance with claim 1, characterized in that the cross-section of the lower shank section (20) corresponds to the cross-section of the holding means (32) of the needle foot (30).

4. Needle in accordance with claim 1, characterized in that the upper shank section (25) has abutment sites (60) that are regularly distributed on its circumference, said abutment sites being arranged on a common lateral cylinder surface (61) about the longitudinal axis (16).

5. Needle in accordance with claim 4, characterized in that the abutment sites (60) extend in the form of a spiral on the lateral cylinder surface (61) of the upper shank section (25).

6. Needle in accordance with claim 4, characterized in that the outside surface of the upper shank section (25) is located outside the abutment sites (60) inside the common lateral cylinder surface (61) of the abutment sites.

7. Needle in accordance with claim 4 characterized in that the abutment sites (60) act as an abutment on a counter support surface (56) of a needle holder (45) of the textile machine in order to fixate the needles (15) transversely with respect to the longitudinal axis (16).

8. Needle in accordance with claim 1, characterized in that the cross-section of the upper shank section (25) has a cross-sectional form that is different from a circular contour.

9. Needle in accordance with claim 1, characterized in that the cross-section of the upper shank section (25) has a polygonal form.

10. Needle in accordance with claim 1, characterized in that the cross-section of the upper shank section (25) has a triangle-like form.

11. Needle in accordance with claim 1, characterized in that the cross-section of the upper shank section (25) has a cross-like or star-like form.

12. Needle in accordance with claim 8, characterized in that corners and/or edges of the cross-sectional form of the upper shank section (25) are curved.

13. Needle in accordance with claim 1, characterized in that the cross-section of the upper shank section (25) has an oval-like or ellipse-like form.

14. Needle in accordance with claim 1, characterized in that the area of the cross-section of the upper shank section (25) essentially corresponds to the area of the cross-section of the lower shank section (20) and/or to the area of the cross-section of the holding means (32) of the needle foot (30).

* * * * *